US008966716B1

(12) United States Patent
Mortimer

(10) Patent No.: US 8,966,716 B1
(45) Date of Patent: Mar. 3, 2015

(54) APPARATUS FOR RESTRAINING DISTAL PORTION MOVEMENT OF NECK-WORN CLOTHING ACCESSORIES

(76) Inventor: Timothy Scott Mortimer, Las Vegas, NV (US)

( * ) Notice: Subject to any disclaimer, the term of this patent is extended or adjusted under 35 U.S.C. 154(b) by 811 days.

(21) Appl. No.: 12/961,869

(22) Filed: Dec. 7, 2010

Related U.S. Application Data

(60) Provisional application No. 61/267,635, filed on Dec. 8, 2009.

(51) Int. Cl.
*A44B 6/00* (2006.01)

(52) U.S. Cl.
USPC ..... 24/66.6; 24/66.2; 24/66.4; 24/56; 24/59; 24/66.5

(58) Field of Classification Search
CPC ..... A41D 25/003
USPC ..... 24/511, 501, 499, 500, 3.11, 3.13, 72.1, 24/56, 59, 62, 64, 66.4, 66.6, 66.8, 43, 44, 24/41.1
IPC ..... A41D 25/003
See application file for complete search history.

(56) References Cited

U.S. PATENT DOCUMENTS

| | | | | | |
|---|---|---|---|---|---|
| 658,630 | A | * | 9/1900 | Felson | 24/499 |
| 1,707,591 | A | * | 4/1929 | Young | 24/66.4 |
| 2,168,946 | A | * | 8/1939 | Rogers | 24/66.4 |
| 3,357,063 | A | * | 12/1967 | Eiben | 24/66.6 |
| 3,499,192 | A | * | 3/1970 | Holtz | 24/66.6 |
| 3,968,544 | A | * | 7/1976 | Sinclair | 24/66.6 |
| 4,987,659 | A | * | 1/1991 | Grandis | 24/499 |

* cited by examiner

*Primary Examiner* — Robert J Sandy
(74) *Attorney, Agent, or Firm* — Khorsandi Patent Law Group, A Law Corporation; Marilyn R. Khorsandi

(57) ABSTRACT

Exemplary embodiments will provide an apparatus for restraining a portion of a distal portion of a neck-worn clothing accessory, such as a neck tie, scarf, or other such clothing accessory, by connecting a rear, or underneath, portion of the clothing accessory to an underlying garment. Exemplary embodiments could restrain a portion of the distal portion of such a neck-worn clothing accessory without piercing or creasing any part of the exposed front surface of the neck-worn clothing accessory. An exemplary embodiment will include an underneath-portion engaging element, a connective element, and an exemplary garment-engaging element.

13 Claims, 8 Drawing Sheets

APPARATUS FOR RESTRAINING DISTAL PORTION MOVEMENT OF NECK-WORN CLOTHING ACCESSORIES

CROSS-REFERENCE TO RELATED APPLICATIONS

This application claims priority to U.S. Provisional Patent Application No. 61/267,635, titled "AN APPARATUS FOR RESTRAINING DISTAL PORTION MOVEMENT OF NECK-WORN CLOTHING ACCESSORIES," filed on Dec. 8, 2009, the entire disclosure of which is incorporated by reference herein for all purposes as if stated in full herein.

FIELD OF THE INVENTION

The field of the present invention is a clothing accessory for restraining movement of a portion, such as a distal end portion, of a clothing accessory, such as neck-worn clothing accessories, such as a neck tie, scarf, or similar neck-worn clothing accessory.

BACKGROUND OF THE INVENTION

A clothing accessory, such as a neck tie or scarf, may be worn around the neck of a wearer, such as around a neck portion of a collared dress shirt. However, unless further measures are taken, the distal ends or portions of such a neck-worn clothing accessory may be free from attachment to the underlying garment and may thereby be unrestrained from interfering movement.

If the distal portion of such a neck-worn clothing accessory is unrestrained, then if the wearer were to lean over a plate of food, the unrestrained distal portion of the clothing accessory could move and possibly contact the food on the plate, possibly resulting in stains and/or damage to the material of the neck tie and/or the underlying garment. Further, if the distal portion of such a neck-worn clothing accessory is unrestrained, then if the wearer were to use machinery, such as, for example, a paper shredder, the distal portion of the neck-worn clothing accessory could move into the machinery and endanger the wearer.

A device for securing, or otherwise restraining, the distal portion of a neck tie or similar clothing accessory may be utilized for the purpose of securing or restraining the distal portion of such a clothing accessory, such as a neck tie, to the underlying garment. Fastening such a device to such a neck-worn clothing accessory may thereby provide some measure of restraint of the distal portion of the clothing accessory, so that the distal portion of the clothing accessory is restrained from free movement, such as from substantially departing away from the underlying garment.

Devices, such as conventional tie clips, exist for restraining the movement of the distal portions of a neck-worn clothing accessory. Some such existing devices, such as a conventional tie clip, may bind or otherwise attach to an exposed, front surface of a neck-worn clothing accessory in order to connect the distal end of the neck-worn clothing accessory to an underlying garment. Because of such an exposed-front-surface attachment to the neck-worn clothing accessory, such an exposed-front-surface-attaching device may create a visual interference with the appearance of the neck-worn clothing accessory, or otherwise create a distraction from the appearance of the neck-worn clothing accessory. In particular, such an exposed-front-surface-attaching device may result in an incongruent overlap by the device with the design and/or the pattern of the exposed front surface of the neck-worn clothing accessory.

Some existing neck-worn restraining devices may operate by piercing a portion of the exposed front surface of the material of the neck-worn clothing accessory. Or, in other cases, existing neck-worn restraining devices may operate by clamping over the exposed front surface of the material of the neck-worn clothing accessory. Such devices may therefore damage the material and texture on the front surface of the neck tie by leaving creases, piercings, or visible imprints of the device.

There exists a need for a device that restrains the distal portions of neck-worn clothing accessories to the underlying garment without interfering with the visual pattern of or causing damage to, or otherwise interfering with the visual appearance of the exposed front surface of the material of the neck-worn clothing accessory.

SUMMARY OF THE INVENTION

Exemplary embodiments of the present invention will provide an apparatus for restraining a portion of a distal portion of a neck-worn clothing accessory, such as a neck tie, scarf, or other such clothing accessory, by connecting a rear, or underneath, portion of the clothing accessory to an underlying garment. Exemplary embodiments of the present invention could restrain a portion of the distal portion of such a neck-worn clothing accessory without piercing or creasing any part of the exposed front surface of the neck-worn clothing accessory. An exemplary embodiment of the present invention will comprise an underneath-portion engaging element, a connective element, and an exemplary garment-engaging element.

Exemplary embodiments of the present invention will be described herein with reference to ties. It will be understood that the description herein of exemplary embodiments of the present invention with reference to ties is illustrative and non-limiting; such exemplary embodiments, or alternative exemplary embodiments, may be used with other types of neck-worn clothing accessories, such as, for example, scarves and the like, without departing from the spirit of the invention.

An exemplary embodiment of an exemplary underneath-portion-engaging element will be adapted to attach to a tie label, a tie loop, or a tie insert that may be located on the underside, or underneath portion, of a neck tie.

The exemplary underneath-portion-engaging element will comprise an exemplary front arm element, an exemplary back element, and an exemplary hinge element. The exemplary back element and exemplary front arm element will be connected to each other with the exemplary hinge element. The exemplary back element and exemplary front arm element will be adapted to rest upon opposing surfaces of the tie label, tie loop, or tie insert. An exemplary barb element at the distal portion of the back element will be adapted to help prevent the distal portions of the exemplary front arm element and exemplary back element from separating and dislodging from the tie label, loop, or tie insert.

An alternative exemplary embodiment of the underneath-portion-engaging element of the present invention will comprise a unitary construction comprising two substantially parallel divisions where therebetween the tie label or tie insert may be positioned. The alternative exemplary embodiment of the underneath-portion-engaging element will be adapted to accommodate a secure fitting therebetween of the tie label or tie insert without being so spaced apart as to allow the tie insert or tie label from unintentionally dislodging therefrom.

The exemplary connective element will comprise a flexible material that connects the exemplary underneath-portion-engaging element and the exemplary garment-engaging element. The exemplary connective element will be adapted to limit the movement of the neck tie and restrict the spacing between the neck tie and the underlying garment to which the exemplary garment-engaging element is to be attached.

An exemplary embodiment of the exemplary garment-engaging element will comprise an exemplary cylindrical rod that will be adapted for fitting through a top side of a button hole of an underlying garment when positioned perpendicular to the plane of the button hole; the exemplary cylindrical rod will be adapted for being secured underneath the bottom side of the button hole of the underlying garment when positioned parallel to the plane of the button hole.

An alternative exemplary garment-engaging element will comprise an exemplary bottom element that will be adapted to attach to a bottom side of a button already attached to the underlying garment and an exemplary top element that will be adapted to attach to a top side of the button. The exemplary top element and exemplary bottom element will be connected together by, and move along the rotational axis of, a hinge element. An exemplary securing element will be adapted to connect the exemplary top element and exemplary bottom element to prevent inadvertent dislodgement of the alternative exemplary garment-engaging element from the button of the underlying garment.

A further alternative exemplary garment-engaging element will comprise a pin that will be adapted for piercing the top surface of the underlying garment and will further comprise an exemplary pin-fastening element that will be adapted for securing the pin; once pierced through the top surface of the underlying garment to the bottom surface of the underlying garment, securing the exemplary pin-fastening element to the pin would prevent detachment of the further alternative exemplary garment-engaging element from the underlying garment.

BRIEF DESCRIPTION OF THE DRAWINGS

These and other features of the present invention are more fully set forth in the following description of exemplary embodiments of the invention. The description is presented with reference to the accompanying drawings in which.

DETAILED DESCRIPTION OF THE INVENTION

A. An Exemplary Underneath-Portion-Engaging Element

Figure 1A:
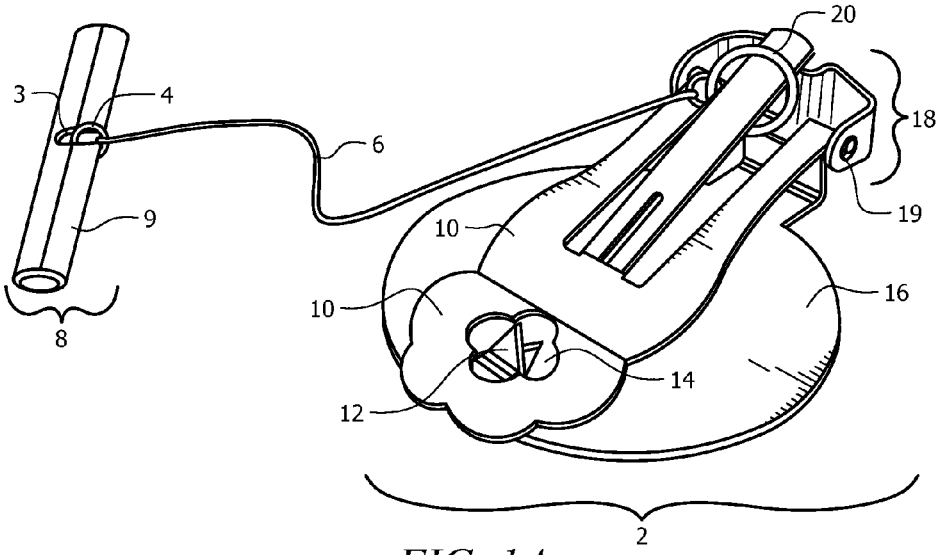
FIG. 1A depicts a top perspective view of an exemplary embodiment of the present invention in a closed position with an exemplary underneath-portion-engaging element connected to an exemplary garment-engaging element by an exemplary connective element.

With reference to FIGS. 1A, 1B, 2A, 2B, 2C, and 2D, the exemplary underneath-portion-engaging element 2 will comprise an exemplary front arm element 10 that is attached to an exemplary back element 16 at an exemplary joint element 18. The exemplary general shape of the exemplary back element 16 will be circular, and the exemplary general shape of the exemplary front arm element 10 will be substantially rectangular, with numerous exemplary curvatures in an exemplary, decorative, longitudinally symmetrical pattern. However, it will be understood by those with ordinary skill in the art that depiction and reference to such exemplary shapes and/or patterns are illustrative and not a limitation of the invention; other shapes and/or patterns could be used without departing from the spirit of the present invention. For example, in various, alternative embodiments, the front arm element 10 and/or the back element 16 of the underneath-portion-engaging element 2 may be square, circular, rectangular, polygonal, comprise other non-geometrical shapes, or could comprise a multitude of combinations thereof.

Continuing with reference to FIGS. 1A, 1B, 2A, 2B, 2C, and 2D, the exemplary material composition of the exemplary back element 16 and the exemplary front arm element 10 will be metal. However, it will be understood by someone with ordinary skill in the art that the exemplary metal composition of this exemplary embodiment is illustrative and not a limitation of the present invention. For example, in alternative embodiments, the front arm element 10 and/or back element 16 of the underneath-portion-engaging element 2 may comprise one or a combination of various solid or semi-solid materials whether now known or in the future discovered, including, but not limited to, various metals and/or plastics.

Continuing with reference to FIGS. 1A, 1B, 2A, 2B, 2C, and 2D, the exemplary embodiment of the exemplary back element 16 will comprise an exemplary engaging barb element 12. The exemplary engaging barb element 12 may be utilized to engage either a tie label 34, or a tie insert 32, (or a tie loop, not shown) both of which may already exist on a neck tie, for the purpose of securing the neck tie to the underneath-portion-engaging element 2.

In the exemplary underneath-portion-engaging element 2, the exemplary engaging barb element 12 will be located on a portion of the back arm element 16 and an exemplary engaging cavity 14 will be located on a portion of the front arm element 10. However, it will be understood by someone with ordinary skill in the art that such locations of the exemplary engaging barb element 12 and engaging cavity 14 are illustrative and not a limitation of the present invention. For example, in an alternative embodiment, the engaging barb element 12 may be located on the front arm element 10 and the engaging cavity element may be located on the back element 16. One of ordinary skill in the art will understand that alternative embodiments of the underneath-portion-engaging element 2 of the present invention may comprise various other orientations of the engaging barb element 12 and/or engaging cavity 14 without departing from the spirit of the present invention.

Further, some alternative embodiments will not have any engaging barb or any engaging cavity.

Continuing with reference to FIGS. 1A, 1B, 2A, 2B, 2C, and 2D, the exemplary shape of the exemplary engaging barb element 12 will be triangular. However, it will be understood by someone with ordinary skill in the art that the exemplary triangular shape of the engaging barb element 12 is illustrative and not a limitation of the present invention. Rather, it will be understood by someone with ordinary skill in the art that alternative exemplary engaging barb elements 12 could comprise alternative shapes that similarly pierce, grip, engage, and/or attach to the tie label 34, tie insert 32, (tie loop, not shown), engaging cavity element 14, and/or other underneath portion of a neck-worn clothing accessory.

Figure 2A:
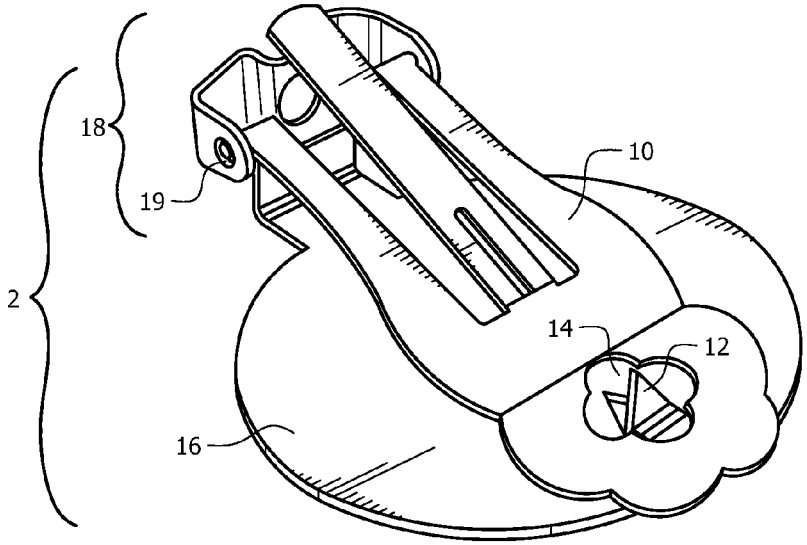
FIG. 2A depicts a top perspective view of an exemplary underneath-portion-engaging element of an exemplary embodiment of the present invention in a closed position.
Figure 2B:
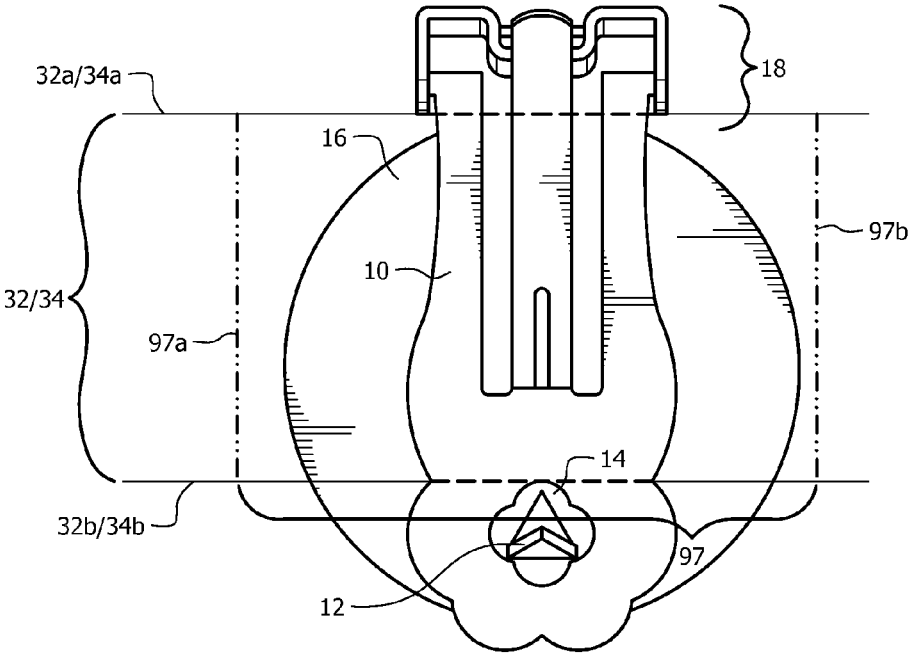
FIG. 2B depicts a top plan view of an alternative exemplary embodiment of an underneath-portion-engaging element in a closed position.
Figure 2C:
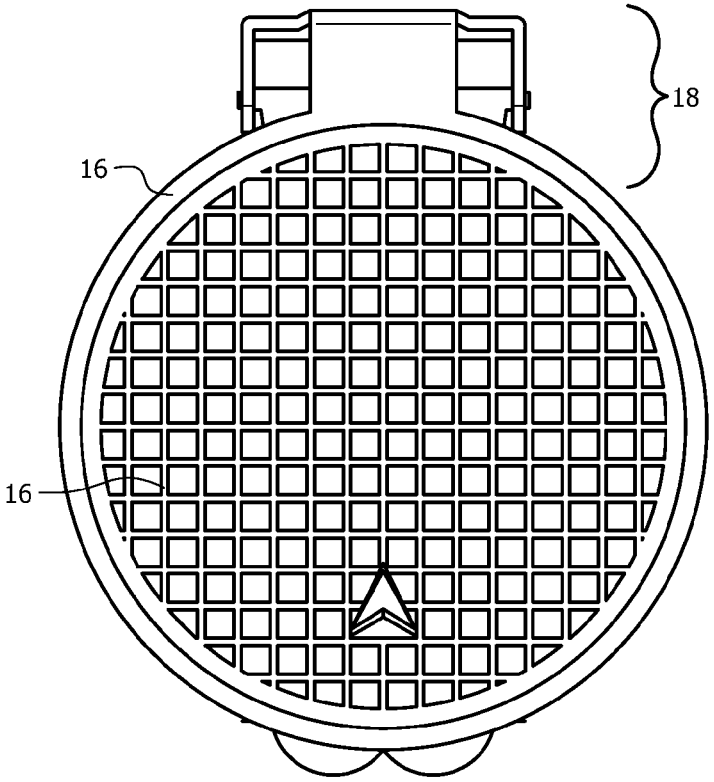
FIG. 2C is a bottom plan view of the alternative exemplary embodiment of the underneath-portion-engaging element in a closed position.
Figure 2D:
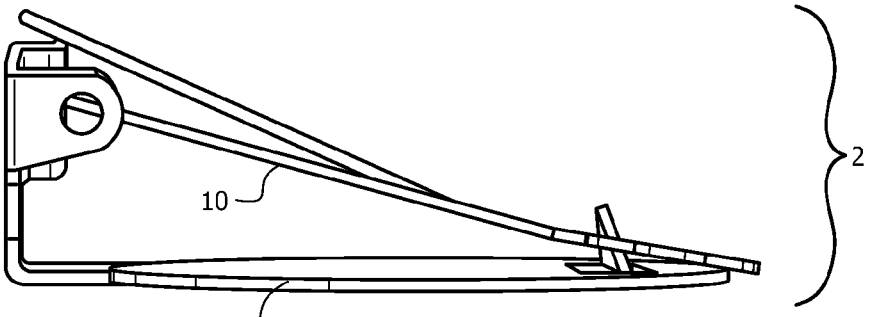
FIG. 2D depicts a side plan view of the alternative exemplary embodiment of the underneath-portion-engaging element in the closed position.
Figure 4A:
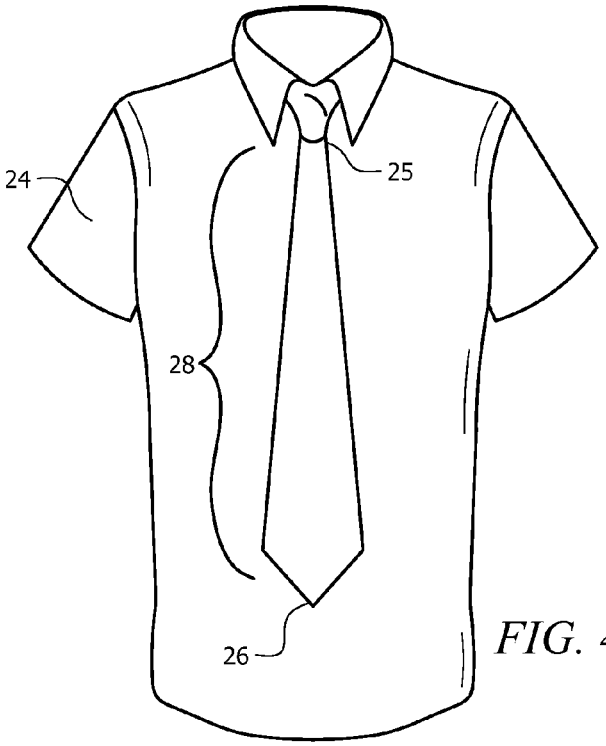
FIG. 4A depicts a plan view of an underlying garment and an exposed front surface of a neck tie.
Figure 4B:
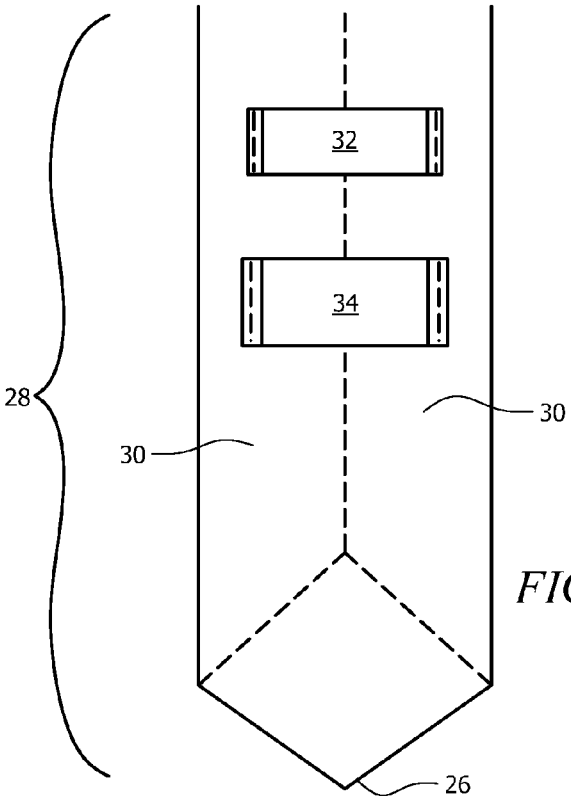
FIG. 4B depicts a plan view of a distal end of a bottom side of a neck tie with both a tie label and tie insert.

The exemplary width of the exemplary back element 16 of the exemplary embodiment of the underneath-portion-engaging element 2 will be of a width less than the total width of a cavity (97 as depicted in FIG. 2B) that is formed between connective means, such as, for examples, stitches (97*a* and 97*b* as depicted in FIG. 2B), that attach the tie label 34 or tie insert 32 to the tie rear surface 30 (as depicted, for example, in FIG. 4B). Such an exemplary width will facilitate the exemplary back element 16 being inserted in cavity 97 (as depicted in FIG. 2B) formed between the connective means, such as, for examples, stitches (97*a* and 97*b* as depicted in FIG. 2B), that attach the tie label 34 or tie insert 32 to the tie rear surface 30 (as depicted, for example, in FIG. 4B).

Figure 5A:
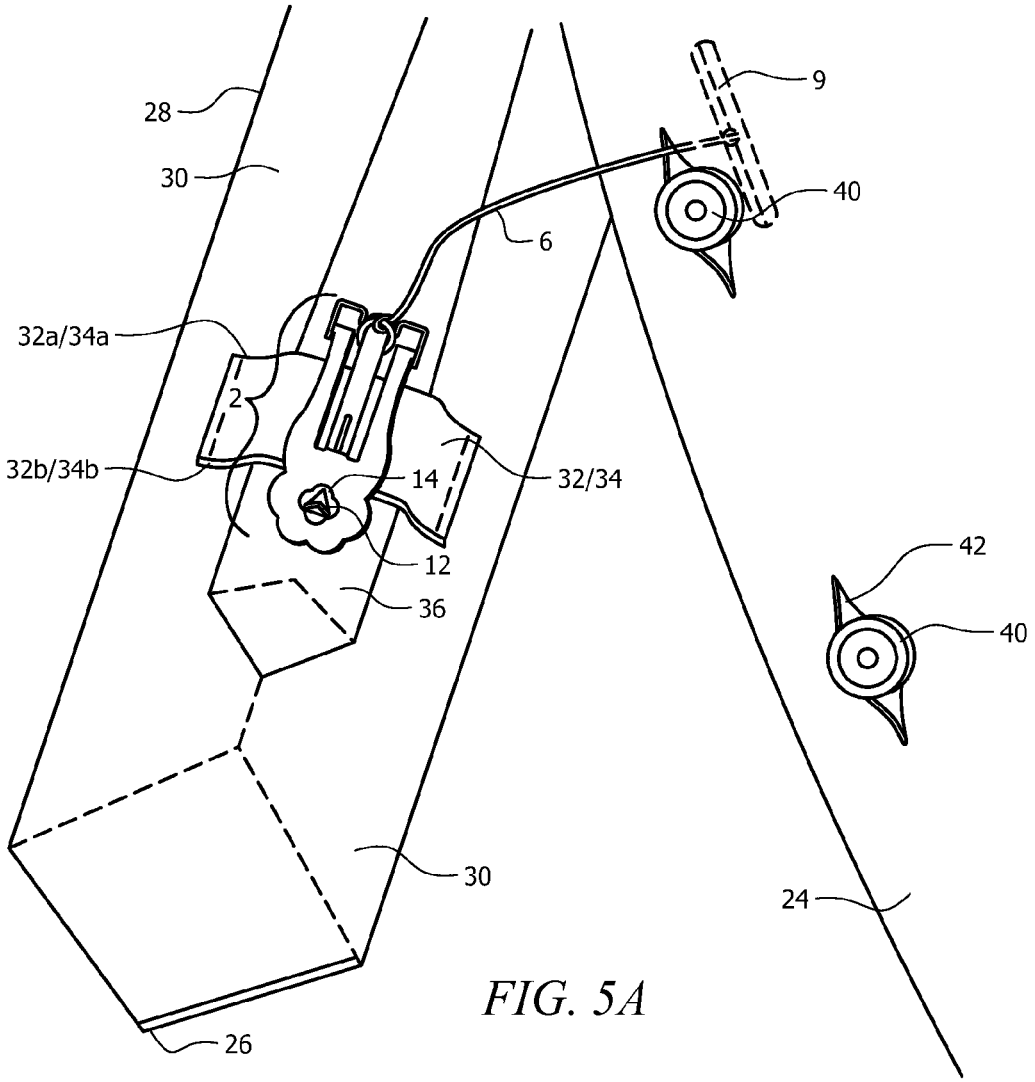
FIGS. 5A and 5B depict perspective views of applications of various exemplary embodiment of the underneath-portion-engaging element and various exemplary embodiments of the exemplary garment-engaging element.
Figure 5B:
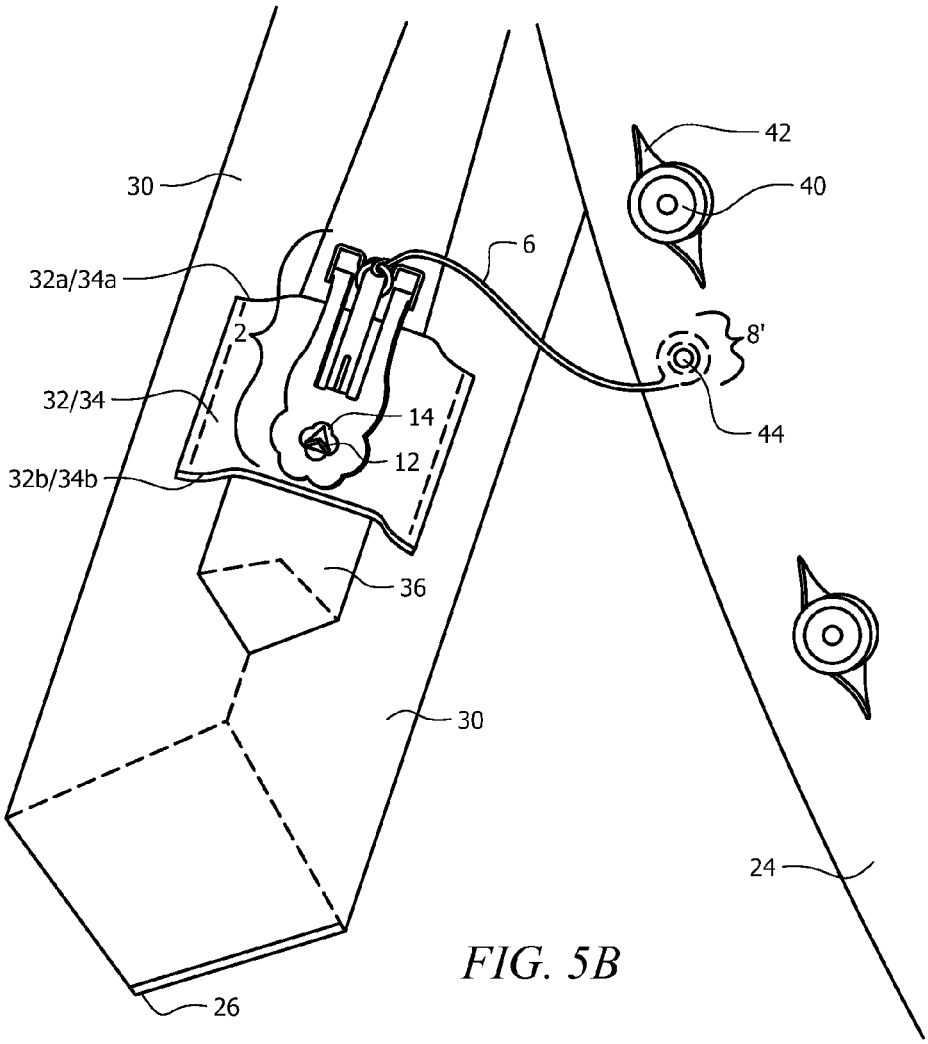

With reference to FIGS. 5A and 5B, an exemplary use of the exemplary underneath-portion-engaging element 2 would comprise a narrow distal end 36 of tie 28 first being inserted in cavity 97 (as depicted in FIG. 2B, formed between the connective means, such as, for examples, stitches (97*a* and 976 as depicted in FIG. 2B)) and then inserting exemplary back element 16 in cavity 97.

With reference to FIG. 2B, the vertical length of the tie label 34 or tie insert 32 is measured as the distance between the vertical high-point 32*a*/34*a* to the vertical low-point 32*b*/34*b*.

Continuing with reference to FIGS. 1A, 1B, 2A, 2B, 2C, and 2D, the exemplary length of the exemplary back element 16 may be of variable length. In some embodiments, the length of exemplary back element 16 will be longer than the vertical length of the tie label 34 or tie insert 32. In other embodiments, the length of exemplary back element 16 will be equal to, or shorter than, the vertical length of the tie label 34 or tie insert 32.

An exemplary engaging barb 12 of an exemplary back element 16 that comprises a length that is longer than the vertical length of the tie label 34 or tie insert 32 may engage the engaging cavity element 14 below the vertical low-point 32*b*/34*b* (such as depicted, for example, in FIGS. 2B and 5A) of the tie label 34 or tie insert 32.

Alternatively, an exemplary engaging barb 12 of an exemplary back element 16 with a length that is equal to, or shorter than, the length of the tie label 34 or tie insert 32 will engage the tie label 34 or tie label 32 below the vertical high-point 32*a*/34*b* but above the vertical low-point 32*b*/34*b* of the tie label 34 or tie insert 32 (such as depicted, for example, in FIG. 5B). However, it will be understood by someone with ordinary skill in the art that the exemplary width and/or length of the exemplary back element 16 are illustrative and not a limitation of the present invention. Rather, it will be understood by someone with ordinary skill in the art that alternative exemplary back element 16 could comprise alternative widths and/or lengths.

The exemplary width dimension of the front arm element 10 will be of a width equal to or less than the width of the exemplary back element 16. The exemplary length of the front arm element 10 may be equal to, or shorter than the length of the back element 16. However, it will be understood by someone with ordinary skill in the art that the exemplary width and/or length of the exemplary front arm element 10 are illustrative and not a limitation of the present invention. Rather, it will be understood by someone with ordinary skill in the art that an alternative exemplary front arm element 10 could comprise an alternative width and/or length.

Figure 1B:
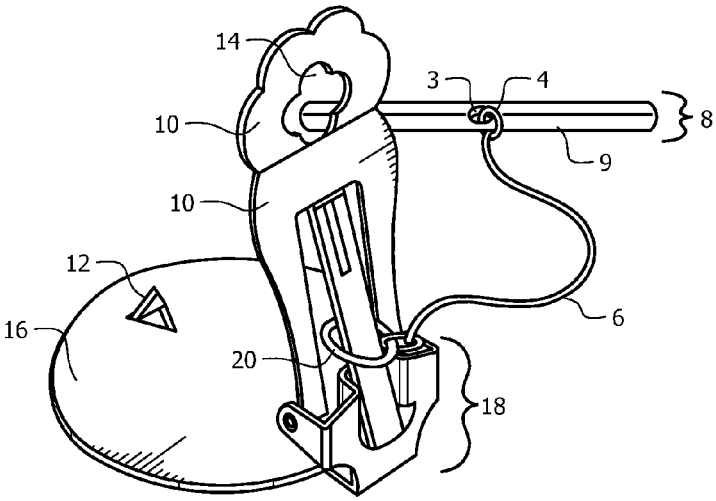
FIG. 1B depicts a top perspective view of an exemplary embodiment of the present invention in an open position with an exemplary underneath-portion-engaging element connected to an exemplary garment-engaging element by an exemplary connective element.

With reference to FIGS. 1A and 1B, the exemplary joint element 18 will connect the exemplary front arm element 10 with the exemplary back element 16. Exemplary joint element 18 will comprise a hinge 19, which will allow the distal ends of the exemplary front arm element 10 with the exemplary back element 16 to swing together and swing apart in order to allow for placement of a tie label 34, tie insert 32, tie loop (not shown), and/or other underneath portion of a neck-worn clothing accessory between exemplary front arm element 10 and exemplary back element 16 and/or to allow for disengagement of exemplary front arm element 10 and exemplary back element 16 from a tie label 34, tie insert 32, tie loop (not shown), and/or other underneath portion of a neck-worn clothing accessory. However, it will be understood by someone with ordinary skill in the art that the depiction of exemplary joint element 18 and exemplary hinge 19 are illustrative and not a limitation of the present invention. Rather, it will be understood by someone with ordinary skill in the art that alternative embodiments of joint element 18 and exemplary hinge 19 of the present invention may take other functionally equivalent forms without departing from the spirit of the invention.

An alternative exemplary embodiment (not shown) of the exemplary joint element 18 will comprise a hinge with a spring, which applies some amount of force between the distal ends of the exemplary back element 16 and exemplary front arm element 10 to maintain the tie label 34 or tie insert 32 therebetween and prevent inadvertent dislodging therefrom.

A further alternative exemplary embodiment (not shown) of the exemplary joint element 18 will comprise a non-hinged, rigid connection between the exemplary back element 16 and exemplary front arm element 10, such that the exemplary back element 16 and exemplary front arm element 10 would not substantially move further together or apart. In such a further alternative exemplary embodiment of the exemplary joint element 18, the spatial relation between the exemplary front arm element 10 and the exemplary back element 16 will comprise no gap whatsoever therebetween, an insubstantial gap therebetween, or, alternatively, a gap equal to, or slightly greater than the thickness of a tie label 34, tie insert 32, tie loop (not shown), and/or other underneath portion of a neck-worn clothing accessory.

In one such further alternative exemplary embodiment (not shown), the underneath-portion-engaging element 2 may comprise unitary construction, comprising a single piece of material, bent such that the spatial relation between the exemplary front arm element 10 and the exemplary back element 16 will comprise no gap whatsoever therebetween, an insubstantial gap therebetween, or, alternatively, a gap equal to, or slightly greater than the thickness of a tie label 34, tie insert 32, tie loop (not shown), and/or other underneath portion of a neck-worn clothing accessory.

In such further alternative exemplary embodiments of the underneath-portion-engaging element 2 the exemplary distance between exemplary front arm element 10 and the exemplary back element 16 of the present invention will be sufficiently small as to allow the insertion or placement of a tie label 34 or tie insert 32 or tie loop (not shown) in the cavity (97 as depicted in FIG. 2B) formed between the connective means, such as, for examples, stitches (97*a* and 97*b* as depicted in FIG. 2B), that attach the tie label 34 or tie insert 32 to the tie rear surface 30 (as depicted for example, in FIG. 4B) between the exemplary front arm element 10 and the exemplary back element 16 using light or moderate force.

With reference, for example, to FIGS. 1A and 1B, an exemplary surface pattern and peripheral shape of the exemplary back element 16 of the present invention will be smooth and round, respectively. However, one of ordinary skill in the art will understand that alternative embodiments of the exemplary back element 16 of the present invention may comprise various other surface patterns and/or shapes without departing from the spirit of the present invention. For example, a surface pattern comprising grit and/or bumps could be used to provide some resistance against slippage of the exemplary underneath-portion-engaging element 2 from behind the cavity (97 as depicted in FIG. 2B) formed between the connective means, such as, for examples, stitches (97*a* and 97*b* as depicted in FIG. 2B), that attach the tie label 34 or tie insert 32 to the tie rear surface 30 (as depicted, for example, in FIG. 4B).

Figure 3A:
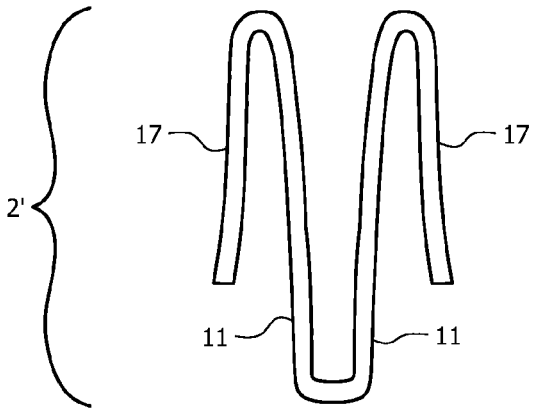
FIG. 3A depicts a side plan view of a further alternative exemplary embodiment of an underneath-portion-engaging element of the present invention.

B. An Alternative Exemplary Embodiment of the Underneath-Portion-Engaging Element With reference to FIGS. 3A and 3B, an alternative exemplary embodiment of the underneath-portion-engaging element 2' will comprise exemplary unitary construction comprising exemplary front arm portions 17 and an exemplary back portion 11. The alternative exemplary embodiment of the underneath-portion-engaging element 2' depicted in FIGS. 3A and 3B will comprise exemplary unitary construction in an exemplary "W"-shape. However, it will be understood by someone with ordinary skill in the art that the exemplary "W"-shape depicted in FIGS. 3A and 3B is exemplary and non-limiting; further alternative shapes and/or dimensions could be used without departing from the spirit of the present invention.

The alternative exemplary underneath-portion-engaging element 2' will be attached to exemplary connective element 6 at the exemplary back portion 11. However, it will be understood by someone of ordinary skill in the art that alternative embodiments of the present invention could include connections made in a number of various locations on the alternative exemplary underneath-portion-engaging element 2', such as, for example, any one connection or combination of connections on the exemplary front arm portions 17, the exemplary back portion 11, or connection points therebetween.

Figure 3B:
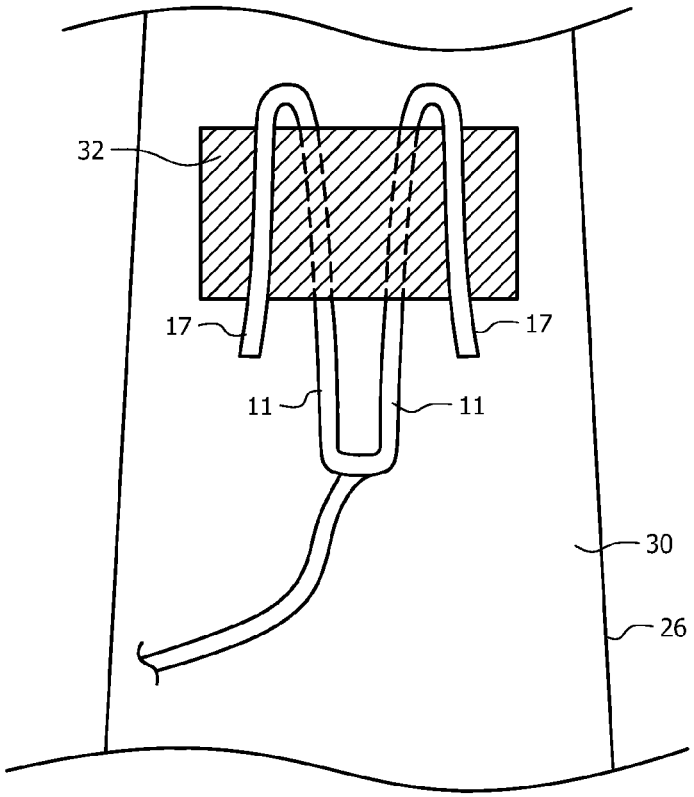
FIG. 3B depicts a side plan view of the further alternative exemplary embodiment of the underneath-portion-engaging element of the present invention as it is adapted for attachment to a tie label or tie insert.

As depicted in FIG. 3B, and with reference to FIGS. 4A, and 4B, exemplary back portion 11 of the alternative exemplary underneath-portion-engaging element 2' would be adapted for sliding or otherwise placing underneath the tie label 34 or tie insert 32 (or tie loop (not shown)), but above the tie rear surface 30. As depicted in FIG. 3B, and with reference to FIGS. 4A, and 4B, exemplary back portion 11 of the alternative exemplary underneath-portion-engaging element 2' would be adapted for inserting the exemplary tie engagement element 2' in the direction from the proximal end 25 to the distal end 26 of the neck tie 28.

With reference to FIG. 3B, upon insertion, the front arm portions 17 will be positioned on a top surface of the tie label 34 or tie insert 32, and the back element will be positioned below a bottom surface of the tie label 34 or tie insert 32 (or tie loop (not shown)). One of ordinary skill in the art will understand that yet further alternative exemplary embodiments of the present invention may include a juxtaposed order of the front arm element 17 and the back element 11 with respect to the tie label 34 or tie insert 32.

With reference to FIGS. 3A and 3B, the material composition of the alternative exemplary underneath-portion-engaging element 2 of the present invention would be metal. However, one of ordinary skill in the arts will understand that alternative embodiments of the exemplary garment-engaging element of this invention could be alternatively composed of any one or combination of various solid or semi-solid materials, whether now known or in the future discovered, including various metals and plastics.

C. An Exemplary Connective Element

With reference to FIGS. 1A and 1B, exemplary connective element 6 would comprise a metal chain. Exemplary material composition of the exemplary connective element 6 would be metal. However, it will be understood by someone with ordinary skill in the art that the exemplary metal material composition of the exemplary connective element 6 of the present invention is illustrative and not a limitation; alternative embodiments could comprise any of various solid or semi-solid materials, whether now known or in the future discovered, including various metals and plastics. In some alternative exemplary embodiments, the connective element 6 could comprise a cord or band of flexible material, such as, by way of non-limiting example, rubber, rubberized plastic, or other material whether now known or in the future discovered.

The exemplary surface pattern of the exemplary connective element 6 will be a chain comprising a bumpy, overlapping array with a general criss-cross pattern. However, it will be understood by someone of ordinary skill in the art that the exemplary surface pattern is illustrative and not a limitation of the present invention; alternative embodiments of the connective element 6 of the present invention may comprise of any of various other textures and/or patterns without departing from the spirit of the present invention.

With reference to FIGS. 1A and 1B, the exemplary attachment between the exemplary connective element 6 and the exemplary underneath-portion-engaging element 2 will comprise an exemplary circular ring element 20 through which a portion of the exemplary front arm element 10 will be inserted. Further, the exemplary attachment between the exemplary connective element 6 and the exemplary garment-engaging element 8 will comprise an exemplary circular ring element 4 which will be adapted to connect with an exemplary detent/indentation element 3 that may be located, for example, at the center of the exemplary length of exemplary garment-engaging element 8. However, it will be understood by someone with ordinary skill in the art that the exemplary circular ring element 20 for attaching the exemplary connective element 6 and the exemplary underneath-portion-engaging element 2, and for attaching exemplary connective element 6 and the exemplary garment-engaging element 8 are illustrative and not a limitation of the present invention; alternative embodiments may utilize functionally equivalent means for connecting the connective element 6 with the underneath-portion-engaging element 2 and/or with exemplary garment-engaging element 8 without departing from the spirit of the invention. For example, one alternative embodiment will comprise a permanently affixed connection, such as, by way of non-limiting example, a soldering point, between the connective element 6 and at least one of the exemplary front arm element 10, exemplary back element 16, and/or joint element 18.

D. Exemplary Garment-Engaging Element

With reference to FIGS. 1A, 1B, and 5A, the exemplary garment engagement element 8 of the present invention will function to engage the underlying garment 24 to the connective element 6 and to tend to prevent its inadvertent disengagement therefrom. The exemplary garment-engaging element 8 will comprise an exemplary cylindrical rod 9. Exemplary cylindrical rod 9 will comprise an exemplary width that would be narrow enough to be inserted through a button hole 42. Exemplary cylindrical rod 9 will be adapted to be positioned perpendicularly to the plane of a button hole 42 on an underlying garment 24 (as depicted, for example, in FIG. 5A), so that exemplary cylindrical rod 9 may be inserted in and through the button hole 42. Subsequently, once the exemplary cylindrical rod 9 has been inserted through the button hole 42 so that the exemplary cylindrical rod 9 will be underneath the surface layer of the underlying garment 24, the exemplary cylindrical rod 9 may be turned and positioned parallel with the plane of the button hole 42, securing the exemplary cylindrical rod 9 of the exemplary garment-engaging element 8 underneath the shirt garment for preventing inadvertent dislodging of the exemplary garment-engaging element 8 from the underlying garment 24. However, one of ordinary skill in the art will understand that the exemplary cylindrical shape of the exemplary cylindrical rod 9 is illustrative and not a limitation of the exemplary garment-engaging element 8 of the present invention; alternative embodiments of the exemplary garment-engaging element 8 may comprise any functionally equivalent method of securing the exemplary connective element 6 of the present invention to either the button 40, button hole 42, or garment material of the underlying garment 24, including, but not limited to, the use of a loop, clasp, clip, elastic band, or any equivalent or combination thereof.

E. Alternative Exemplary Garment-Engaging Element

Figure 6A:
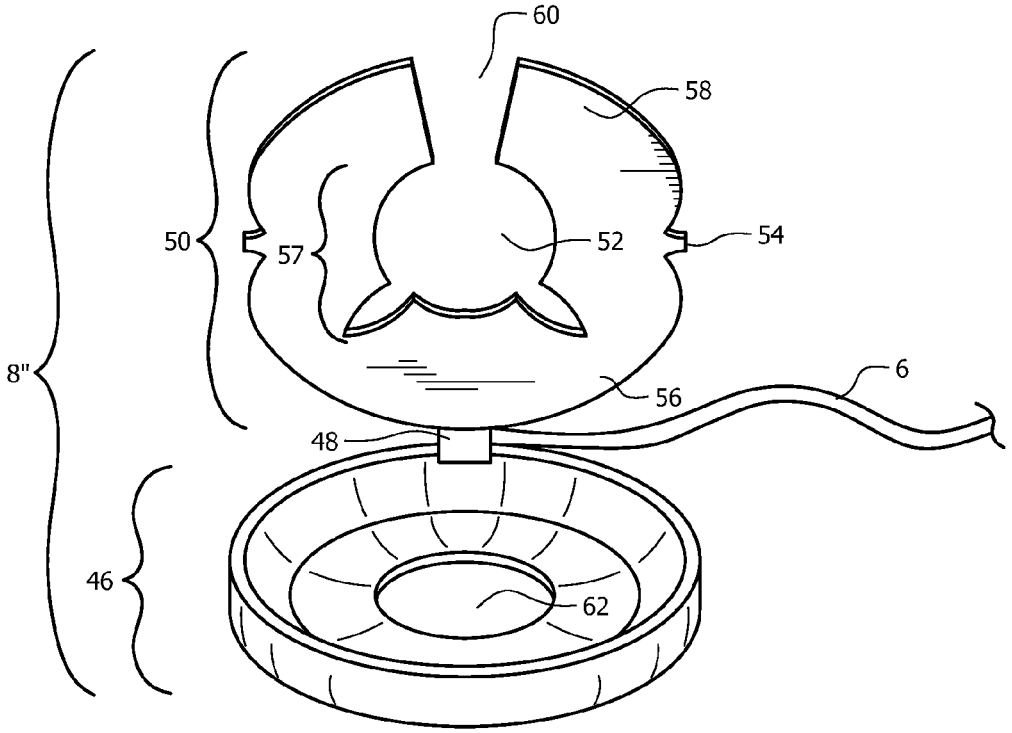
FIG. 6A depicts a perspective view of a further alternative exemplary embodiment of a garment-engaging element of the present invention.
Figure 6B:
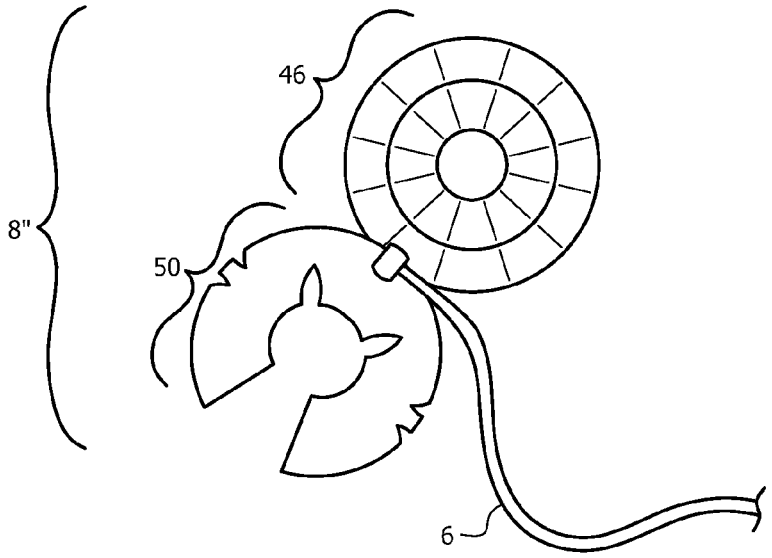
FIG. 6B depicts a plan view of the further alternative exemplary embodiment of the garment-engaging element of the present invention.

With reference to FIGS. 6A and 6B, an exemplary alternative embodiment of the exemplary garment-engaging element 8" of the present invention will comprise exemplary button-engaging element 8" comprising a circular bottom element 50 that will be connected to a circular top element 46 by a hinge element 48. The exemplary bottom element 50 will comprise a distal end 58 and a proximal end 56. The distal end 58 of the bottom element 50 will comprise an opening 60. The exemplary alternative embodiment of the exemplary garment-engaging element 8" will be adapted for a button (not shown in FIGS. 6A and 6B) to be slidably inserted into opening 60 in a direction parallel to the plane of exemplary bottom element 50, so that stitching (not shown in FIGS. 6A and 6B) or other manner of attaching the button to the underlying garment will be generally positioned in cavity 52 of exemplary bottom element 50, and so that the bottom surface of the button (not shown in FIGS. 6A and 6B) will be in contact with the top surface 57 of exemplary bottom element 50. After a button (not shown in FIGS. 6A and 6B) is slidably inserted, exemplary top element 46 will be adapted to be pivoted using exemplary hinge element 48 such that exemplary top element 46 may be positioned atop exemplary bottom element 50 and the button (not shown in FIGS. 6A and 6B).

Exemplary top element 46 of the exemplary alternative embodiment of the exemplary garment-engaging element 8" will comprise an exemplary button cavity 62.

Exemplary top element 46 will comprise one or more exemplary securing elements 54 located on the periphery of exemplary bottom element 50. Exemplary securing elements 54 will be adapted to grip edges of exemplary top element 46 and prevent the button from inadvertent dislodgement. Exemplary top element 46 with exemplary securing elements 54 will be adapted to snap shut into the exemplary bottom element 50 with light or moderate pressure or force.

Once the exemplary top element 46 with exemplary securing elements 54 is snapped shut into the exemplary bottom element 50, the above-described exemplary alternative embodiment of the exemplary garment-engaging element 8" would substantially surround or encapsulate the button within an exemplary button cavity 62 of the exemplary top element 46 of the exemplary alternative embodiment of the exemplary garment-engaging element 8".

The alternative exemplary garment-engaging element 8" will be connected to the exemplary connective element 6.

F. Further Alternative Exemplary Garment-Engaging Element

With reference to FIG. 5B, a further exemplary alternative embodiment of the exemplary garment-engaging element 8' of the present invention will comprise an exemplary pin 44 or similar means for piercing and attaching to the underlying garment 24. Exemplary pin 44 of such a further alternative exemplary embodiment of the exemplary garment-engaging element 8' will be adapted to pierce a layer of the underlying garment 44. Such a further alternative exemplary embodiment of the exemplary garment-engaging element 8' will be adapted to utilize a mechanism for securing the exemplary pin 44 to the underlying garment 24 to prevent unintentional or inadvertent dislodgement. The exemplary pin 44 of such a further alternative exemplary embodiment of the exemplary garment-engaging element 8' of the present invention may be used to attach to an area of the underlying garment 24 either through a button hole, e.g., button hole 42, or some other portion of the underlying garment 24. Some portion of this alternative embodiment of the exemplary garment-engaging element 8' would be attached to the exemplary connective element 6.

Exemplary material composition of the above described exemplary embodiments of the exemplary garment-engaging element 8' of the present invention would be metal. However, one of ordinary skill in the art will understand that alternative embodiments of the exemplary garment-engaging element 8' of the present invention may be composed of any one or combination of various solid or semi-solid materials, whether now known or in the future discovered, including various metals and plastics. An exemplary surface type of such further alternative exemplary embodiments of the exemplary garment-engaging element 8' of the present invention would be smooth. However, one of ordinary skill in the art will understand that alternative embodiments of the exemplary garment-engaging element 8' of the present invention may comprise any one, or combination, of various other surface types and/or patterns.

It will be understood by someone with ordinary skill in the art that other features and properties of the present invention are implicit and/or inherent in the above-provided description of the invention, and/or are depicted and/or are implicit and/or are inherent in the accompanying Figures.

FACSIMILE REPRODUCTION OF COPYRIGHT MATERIAL

A portion of the disclosure of this patent document contains material which is subject to copyright protection by the copyright owner, Timothy Scott Mortimer, and/or his successors and/or assigns. The copyright owner has no objection to the facsimile reproduction by anyone of the patent document or the patent disclosure, as it appears in the Patent and Trademark Office patent file or records, but otherwise reserves all copyright rights whatsoever.

ILLUSTRATIVE EMBODIMENTS

Although this invention has been described in certain specific embodiments, many additional modifications and variations would be apparent to those skilled in the art. It is, therefore, to be understood that this invention may be practiced otherwise than as specifically described. Moreover, to those skilled in the various arts, the invention itself herein will suggest solutions to other tasks and adaptations for other applications. Thus, the embodiments of the invention described herein should be considered in all respects as illustrative and not restrictive, the scope of the invention to be determined by the appended claims and their equivalents rather than the foregoing description.

What is claimed is:

1. An apparatus for restraining a distal portion of a neck-worn clothing accessory to an underlying garment, the apparatus comprising:

an underneath-portion-engaging element that is adapted for connecting to a cavity-forming expanse of material attached on each of its ends to an underneath portion of the neck-worn clothing accessory, said underneath-portion-engaging element comprising:

a front arm that is adapted for positioning on a top surface of said cavity-forming expanse of material, said front arm comprising a planar front element that comprises a top side and a bottom side;

a back element that is adapted for positioning in a cavity formed between the underneath portion of the tie and said cavity-forming expanse of material, said back element comprising a planar back arm that comprises a top side and a bottom side; and a joint element connecting said front arm and said back element; and a connective element comprising a first end connected to the underneath-portion-engaging element and a second end connected to a garment-engaging element.

2. The apparatus of claim 1, wherein said joint element comprises a tension spring element that is adapted to impose a force pushing together opposing ends of said front arm and said back element.

3. The apparatus of claim 1, wherein said joint element comprises a rigid connection between said front arm and said back element, forming a space for inserting said underneath portion of the tie therebetween.

4. The apparatus of claim 1, wherein said planar back arm of said back element further comprises a garment-engaging barb that:

engages said cavity-forming expanse of material with said front arm, said garment-engaging barb protruding out from said planar back arm.

5. The apparatus of claim 1, wherein said joint element is adapted for facilitating the front arm and the back element to swing together or swing apart.

6. The apparatus of claim 4, wherein said planar front element of said front arm further comprises an engaging cavity element that is adapted to engage with said cavity-forming expanse of material engaged by said engaging barb, said engaging cavity element protruding into said planar front element.

7. The apparatus of claim 1, wherein said garment-engaging element comprises a narrow cylindrical bar that is adapted to be inserted into a button hole of an underlying garment.

8. The apparatus of claim 1, wherein said garment-engaging element comprises a button-capturing element that is adapted to surround a button on an underlying garment.

9. An apparatus for restraining a distal portion of a neck-worn clothing accessory to an underlying garment, the apparatus comprising:

an underneath-portion-engaging element that is adapted for connecting to a cavity-forming expanse of material attached on each of its ends to an underneath portion of the neck-worn clothing accessory, said underneath-portion-engaging element comprising:

a front arm that is adapted for positioning on a top surface of said cavity-forming expanse of material attached to said underneath portion of the neck-worn clothing accessory, said front arm comprising a planar-shaped front element that comprises a top planar-shaped side and a bottom planar-shaped side, a back element that is adapted for positioning in a cavity formed between the underneath portion of the neck-worn clothing accessory and the cavity-forming expanse of material attached to said underneath portion of the neck-worn clothing accessory, said back element comprising a planar-shaped back arm that comprises a top planar-shaped side and a bottom planar-shaped side, and a joint element connecting said front arm and said back element;

a garment-engaging element that is adapted for connecting to an underlying garment; and a connective element comprising a first end connected to the underneath-portion-engaging element and a second end connected to the garment-engaging element.

10. The apparatus of claim 9, wherein said front arm further comprises an engaging cavity and said back element further comprises an engaging barb element that is adapted to engage material into said engaging cavity, wherein said engaging cavity protrudes into said planar-shaped front element, and wherein said engaging barb protrudes out from said planar-shaped back arm.

11. The apparatus of claim 10, wherein said joint element comprises a tension spring that is adapted to impose a force for pushing together opposing ends of said front arm and said back element.

12. The apparatus of claim 9, wherein said bottom planar-shaped side of said planar back arm of said back element further comprises a garment-engaging barb that is adapted for engaging said cavity-forming expanse of material with said front arm, said garment-engaging barb protruding from said bottom planar-shaped side of said planar-shaped back arm.

13. The apparatus of claim 12, wherein said bottom planar-shaped side of said planar-shaped front element of said front arm element further comprises an engaging cavity element that is adapted to engage with said cavity-forming expanse of material engaged by said garment-engaging barb, said engaging cavity element protruding into said bottom planar-shaped side of said planar-shaped front element.

* * * * *